US006435259B1

(12) United States Patent
Baker et al.

(10) Patent No.: US 6,435,259 B1
(45) Date of Patent: Aug. 20, 2002

(54) CORE ASSEMBLY METHOD FOR CYLINDER HEAD CASTINGS

(75) Inventors: Stephen G. Baker, Spencer; Joshua M. Werling, Fishers, both of IN (US)

(73) Assignee: International Engine Intellectual Property Company, L.L.C., Warrenville, IL (US)

( * ) Notice: Subject to any disclaimer, the term of this patent is extended or adjusted under 35 U.S.C. 154(b) by 0 days.

(21) Appl. No.: 09/748,792

(22) Filed: Dec. 22, 2000

(51) Int. Cl.[7] ..... B22D 33/04; B22C 9/10; B22C 1/00; B22C 9/00

(52) U.S. Cl. ..... 164/137; 164/370; 164/24

(58) Field of Search ..... 164/137, 369, 164/228, 18, 24, 370, 232, 30

(56) References Cited

U.S. PATENT DOCUMENTS 4,932,459 A * 6/1990 Erana ..... 164/24
5,119,881 A * 6/1992 Cagle ..... 164/137
5,839,498 A * 11/1998 Uzaki et al. ..... 164/137

FOREIGN PATENT DOCUMENTS

JP 60121038 A * 6/1985
JP 62013240 A * 1/1987

* cited by examiner

*Primary Examiner*—M. Alexandra Elve
*Assistant Examiner*—Kevin McHenry
(74) *Attorney, Agent, or Firm*—Dennis Kelly Sullivan; Jeffrey P. Calfa; Neil T. Powell

(57) ABSTRACT

A method of fastening core elements together without the use of foreign agencies, such as adhesives, screws or other such fasteners, uses the same core sand and resin that form the core elements themselves. Core sand elements are retained in an assembly by bodies of cured core sand and resin in holes or cavities that span the interface between the core elements and fasten the core sand elements together. Core sand elements are provided with alignable holes, or cavities, into which a mixture of core sand and a curable resin, preferably the same resin used in forming the core sand elements, is added and the curable resin is cured to provide a body of cured core sand and resin, preferably adhering to the core sand elements, fastening the core sand elements together.

7 Claims, 4 Drawing Sheets

FIG. 3
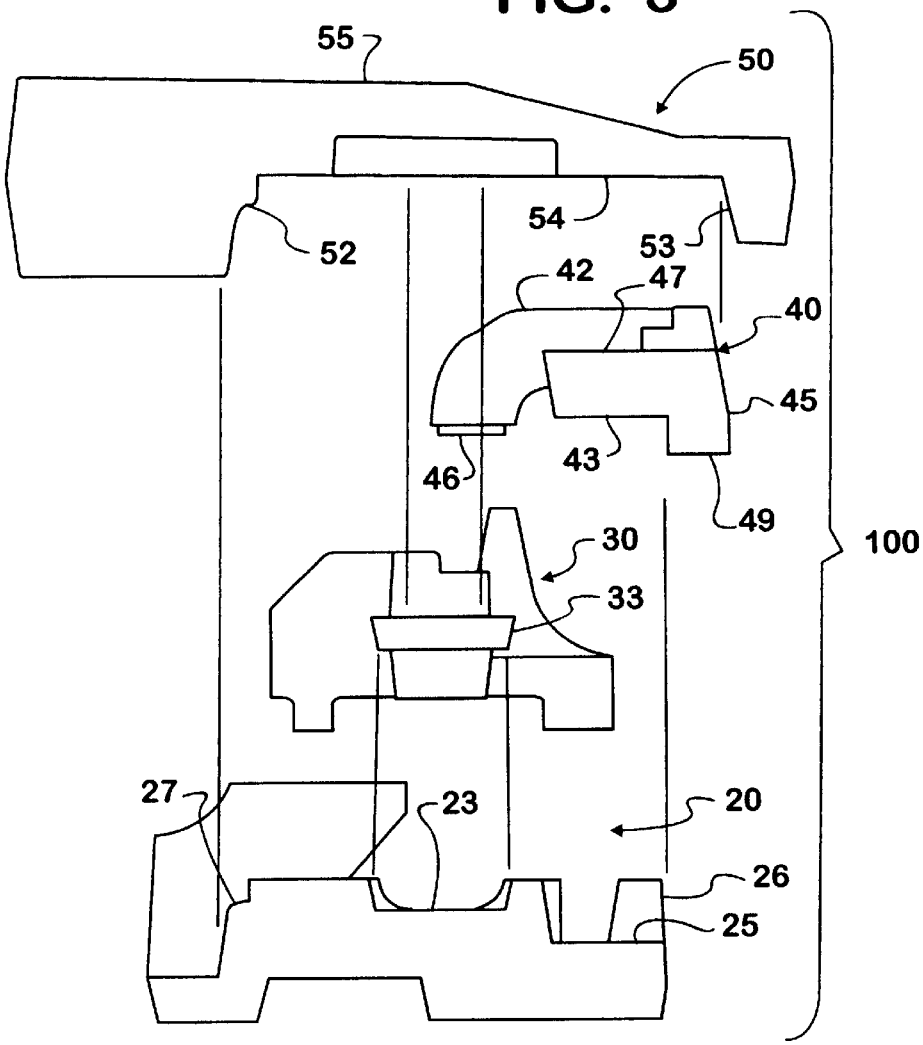
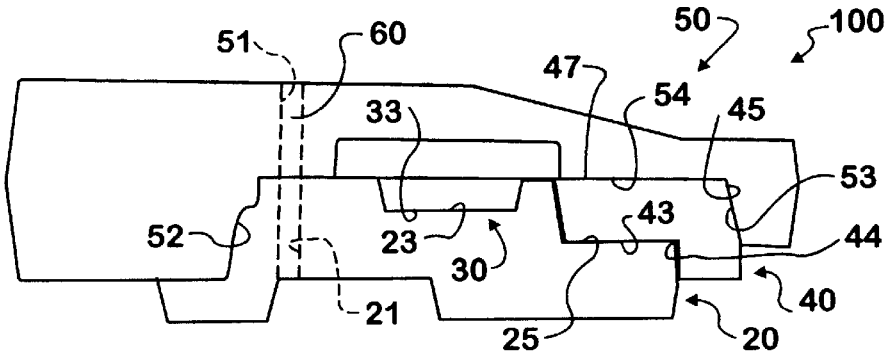
FIG. 4

CORE ASSEMBLY METHOD FOR CYLINDER HEAD CASTINGS

FIELD OF THE INVENTION

This invention relates to methods for casting cylinder heads for internal combustion engines, and more particularly to methods of assembling core elements of core assemblies.

BACKGROUND OF THE INVENTION

The manufacture of cylinder heads for internal combustion engines poses difficult manufacturing problems. The cylinder head of an internal combustion engine, whether for a spark driven gasoline internal combustion engine or a compression ignition diesel engine, is a complex article of manufacture with many requirements. A cylinder head generally closes the engine cylinders and contains the many fuel explosions that drive the internal combustion engine, provides separate passageways for the air intake to the cylinders for the engine exhaust, carries the multiplicity of valves needed to control the air intake and engine exhaust, provides a separate passageway for coolant to remove heat from the cylinder head, and can provide separate passageways for fuel injectors and the means to operate fuel injectors.

The walls forming the complex passageways and cavities of a cylinder head must withstand the extreme internal pressures, temperatures and temperature variations generated by the operation of an internal combustion engine, and must be particularly strong in compression-ignition diesel engines. On the other hand, it is desirable that the internal walls of the cylinder head, particularly those walls between coolant passageways and the cylinder closures, permit the effective transfer of heat from the cylinder head, and it is also important that the cylinder head include minimal metal to reduce its weight and cost.

These countervailing requirements make the manufacture of reliable cylinder heads difficult. Furthermore, these complex parts are manufactured by the thousands and assembled into vehicles that must operate reliably under a variety of conditions. The manufacture of reliable cylinder heads is particularly important because of the high cost of their replacement. Consequently, the manufacture of cylinder heads has been the subject of the developmental efforts of engine and automobile manufacturers throughout the world for years.

Cylinder heads are most generally manufactured by casting them from iron alloys. The casting of the cylinder head portion that closes the cylinders, carries the intake and exhaust valves and fuel injectors and provides the passageways for the air intake, exhaust and coolant requires a mold carrying a plurality of core elements. To provide effective cooling of the cylinder head and effective air intake and exhaust from the cylinders of the internal combustion engine, the passageways for the air intake and exhaust are best interlaced with the coolant passageways within the cylinder head portion. The cavities for coolant, air intake and exhaust must, of course, be formed by core elements within the mold that can be removed when the casting metal solidifies.

Such core elements are formed from a mixture of core sand and a curable resin, which, when cured, retains the shape imposed on it prior to curing, and after a casting solidifies, the core sand and resin residue are removed from the casting.

As a result of recent developments, core assemblies are provided by a plurality of core elements that have interengaging surfaces to locate the plural core elements in the core assembly. For example, head core assemblies can be formed by the assembly of a one-piece coolant jacket core, a one-piece exhaust core, and a one-piece air intake core that interengage during their assembly; however, to maintain such an assembly together as a unit during post assembly handling and casting, the core elements must be fastened together. In the past, adhesive and/or screws have been used to fasten at least two core elements together to maintain the integrity of the core assembly during its handling and during pouring of the casting.

The use of an adhesive requires an adhesive that can be easily spread on the core elements, that will set within the shortest possible time; that will hold the core elements together as one piece and maintain their position during the casting process, and that may be removed from the casting after the casting metal solidifies. This method results in substantial costs and opportunities for unreliable castings because of a potentially unreliable interface between the core elements. It is necessary that workmen apply the adhesive correctly so that the adhesive reliably maintains the core elements together during casting. Furthermore, this method requires time for applying the adhesive, assembling the core elements together and allowing the adhesive to set before the core elements can be used for casting, and it introduces into the mold an unnecessary foreign element in the form of an adhesive that may evolve gas that may become trapped in the solidified casting and cause areas of possible failure.

Because of the difficulties of using adhesive to fasten core elements together, the use of screws to fasten together the core elements of core assemblies has been preferred. Although the use of screws to fasten core elements together provides a more predicable assembly of the core elements, it can introduce screws into the casting, which may not be removed after the casting has solidified and may cause failure of an assembled engine.

BRIEF SUMMARY OF THE INVENTION

The invention provides a method of fastening assembled core elements together without the use of foreign agencies, such as adhesives, screws or other such fasteners, using instead the same core sand and resin that form the core elements themselves.

In the invention, core sand elements are retained in an assembly by a body of cured core sand and resin that spans the interface between the core elements and fastens the core sand elements together. The core sand elements are fastened together by providing the core sand elements with alignable holes, or cavities, inserting a mixture of core sand and a curable resin, preferably the same resin used in forming the core sand elements, into the holes or cavities of the core elements to provide a body of uncured core sand/resin in the holes, or cavities, and at the interface, and curing the curable resin to provide a body of cured core sand and resin, preferably adhering to the core sand elements, fastening the core sand elements together. In a preferred method of the invention, holes are drilled in the assembly elements after they are assembled and a fluent mixture of core sand and uncured resin is compacted into the drilled holes to provide improved adhesion between the cured core sand/resin fastening elements and the hole surfaces of the assembled core elements.

Other steps, features and advantages of the invention will be apparent to those skilled in the art from the drawings and more detailed description of the best known mode of the invention that follows.

BRIEF DESCRIPTION OF THE DRAWINGS

FIG. 3 illustrates, as an example, head core elements that can be fastened together with the invention.

FIG. 4 illustrates the head core assembly of FIG. 3 as fastened together with the invention.

DETAILED DESCRIPTION OF THE BEST KNOWN MODE OF THE INVENTION

Figure 1:
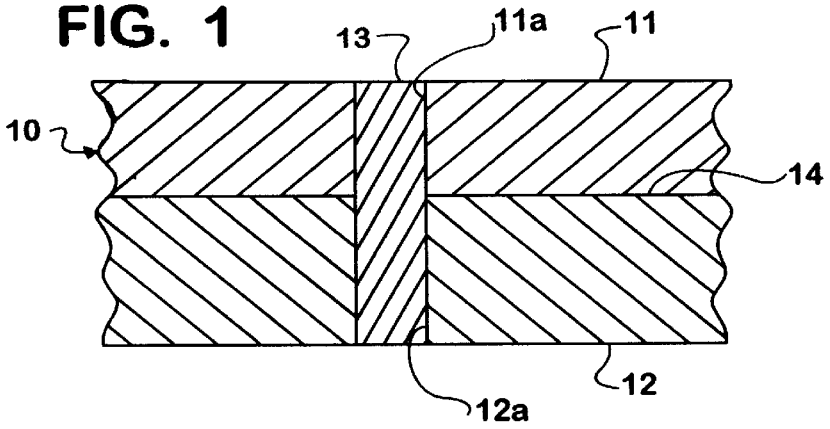
FIG. 1 is a cross-section of the core elements that have been fastened together in an assembly with the method of this invention.

FIG. 1 illustrates an assembly 10 of the invention comprising core elements 11, 12 both of which are formed by core sand and a cured resin, such as the resin used in the phenolic urethane cold box process that is well-known in the art, comprising a phenolic resin and an isocyanate resin, blended in the ratio of 55 parts to 45 parts, respectively, and cured with a triethylamine catalyst after formation of the mold elements. In accordance with the invention, the core elements 11 and 12 are joined by a body 13 of the same cured core sand and resin that comprise core elements 11 and 12. As indicated by FIG. 1, alignable holes 11*a* and 12*a* have been formed in the core elements 11 and 12, and the aligned holes 11*a* and 12*a* have been filled with the body 13 of cured core sand and resin which spans interface 14 between the core elements 11 and 12, and preferably adheres to the surfaces forming holes 11*a* and 12*a*.

Figure 2A:
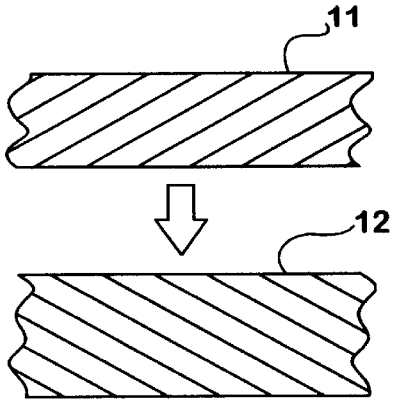
FIGS. 2A–2D diagrammatically illustrate a preferred method of the invention.
Figure 2B:
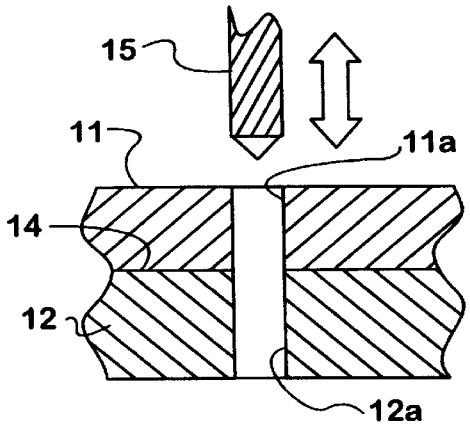
Figure 2C:
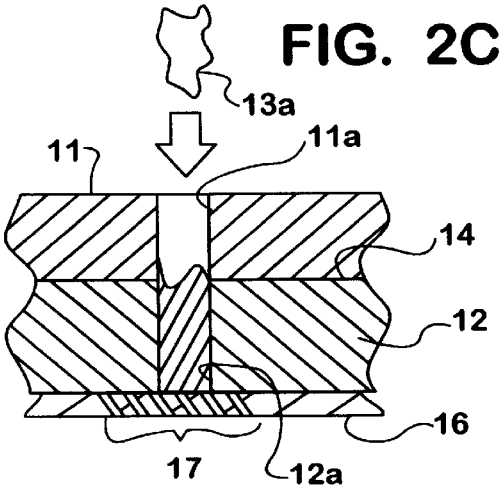
Figure 2D:
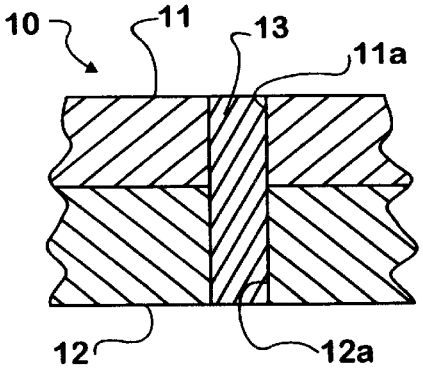

FIGS. 2A–2D illustrate a preferable method of retaining two core sand elements in an assembly by a body of cured core sand and resin spanning their interface. In the illustrated method, a first core element 11 is placed against a second core element 12, as indicated by the arrow in FIG. 2A. After core elements 11 and 12 are assembled, the assembled core elements are provided with aligned holes 11*a* and 12*a*, preferably by the use of a drill 15, as indicated by the arrows in FIG. 2B. Although it is preferable to provide the assembled core elements 11 and 12 with the holes 11*a* and 12*a* after they are assembled, by drilling as indicated in FIG. 2B, so the surfaces forming the holes 11*a* and 12*a* of core elements 11 and 12 will be more receptive to adhesion with the cured core sand/resin fastening body 13, alignable holes or cavities with shapes other than cylindrical may be formed in the core elements at the time the individual core elements are formed. After the core elements 11 and 12 are assembled and provided with aligned holes 11*a* and 12*a*, the assembled core elements are provided with a backing plate 16, which is preferably sufficiently perforate (e.g., at 17) to allow the passage of air, and an uncured fluent mixture of core sand and resin 13*a* is added to and compacted within the aligned holes 11*a*, 12*a* until it at least spans the interface 14. After the removal of packing plate 16, the uncured core sand resin mixture is cured in the holes 11*a* and 12*a* to provide the cured body of core sand and resin 13 which retains core elements 11, 12 in the assembly 10 (FIG. 2D).

FIG. 3 illustrates, as an example, head core elements that can be fastened together in a head core assembly with the invention.

In casting a cylinder head with a method of the invention, for example, a one-piece coolant jacket core 30 having a plurality of core supporting and positioning surfaces and a frame core 20 having a plurality of core supporting and positioning surfaces may be provided, and the one-piece coolant jacket core 30 may be supported and positioned on the frame core by engaging corresponding core supporting and positioning surfaces of the coolant jacket core and the frame core. As shown in FIG. 3, the coolant jacket core 30 may be lowered into the frame core 20 with a supporting and positioning surface, e.g., 33, of the one-piece coolant jacket core engaged with supporting and positioning surface, e.g., 23, of the frame core 20. A one-piece exhaust core 40 having a plurality of exhaust passageway-forming portions, such as 42, with a plurality of core supporting portions, such as 46, may be inserted into the assembled frame core and coolant jacket core by extending the elongated exhaust passage-forming portions, e.g., 42, which project transversely outwardly from the exhaust core, through openings (not shown) in the coolant jacket core 30, and the one-piece exhaust core 40 may be supported and positioned in the assembly by engaging the plurality of corresponding core supporting and engaging surfaces of the exhaust core, e.g., 43, 44, and the frame core, e.g., 25, 26. An intake core 50 having a plurality of core supporting and positioning surfaces adapted to engage the frame core 20, the coolant jacket core 30 and the exhaust core 40 completes a core assembly 100 with the core elements positioned together for formation of a head core assembly. The intake core 50 provides a plurality of air intake passage-forming portions, e.g., 54, that extend transversely outwardly from the frame, and the intake core 50 is located on the assembled frame core 20, coolant jacket core 30 and exhaust core 40 by a plurality of core supporting and positioning surfaces, e.g., 52, 53, 54, engaging the corresponding core supporting and positioning surfaces of the frame core, e.g., 27, coolant jacket core, e.g., 33, and exhaust core, e.g., 45, 47, locking the core elements, by their engagement, into an integral unit. Core assemblies with interlocking core elements are further described in U.S. Pat. No. 5,119,881.

As explained with respect to FIGS. 1 and 2 and as shown in FIG. 4, in the invention the intake core 50 and frame core 20 are provided with holes, or cavities, 51 and 21, for example, by drilling the holes 51, 21 after the intake core 50 and frame core 20 are assembled. As indicated in FIG. 4, a mixture of core sand and uncured resin, preferably the same resin as used in the formation of core elements 50 and 20, is placed in the aligned holes, or cavities, 51, 21, and preferably compacted, and the resin is cured to provide a cured core sand resin fastening element 60, which fastens the assembled core elements 20, 30, 40, 50 together in the head core assembly 100. While FIG. 4 illustrates, as an example, only one set of holes or cavities 51, 21 and one cured core sand/resin fastening body 60, those skilled in the art will recognize that the core elements 20, 30, 40, 50, or any sets of two of them, may be provided with cured core sand/resin fasteners as may be needed or advisable.

Figure 5:
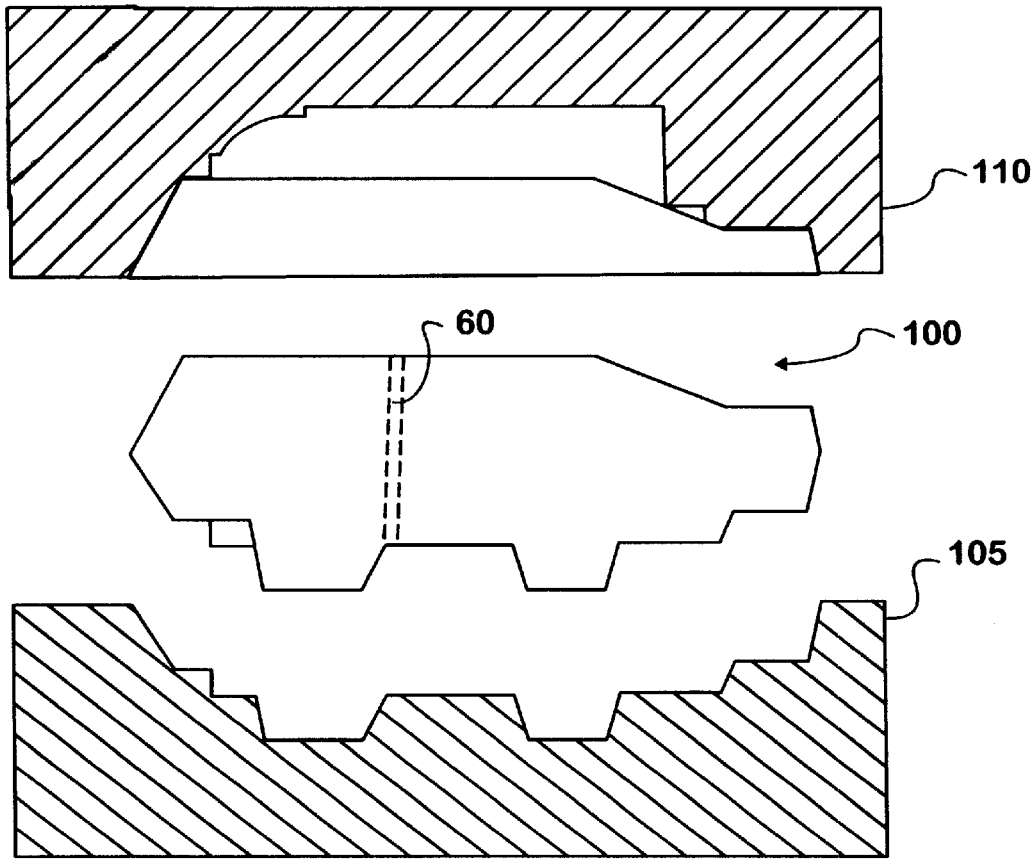
FIG. 5 diagrammatically illustrates the fastened head core assembly of FIG. 4 being assembled with a green sand mold.
Figure 6:
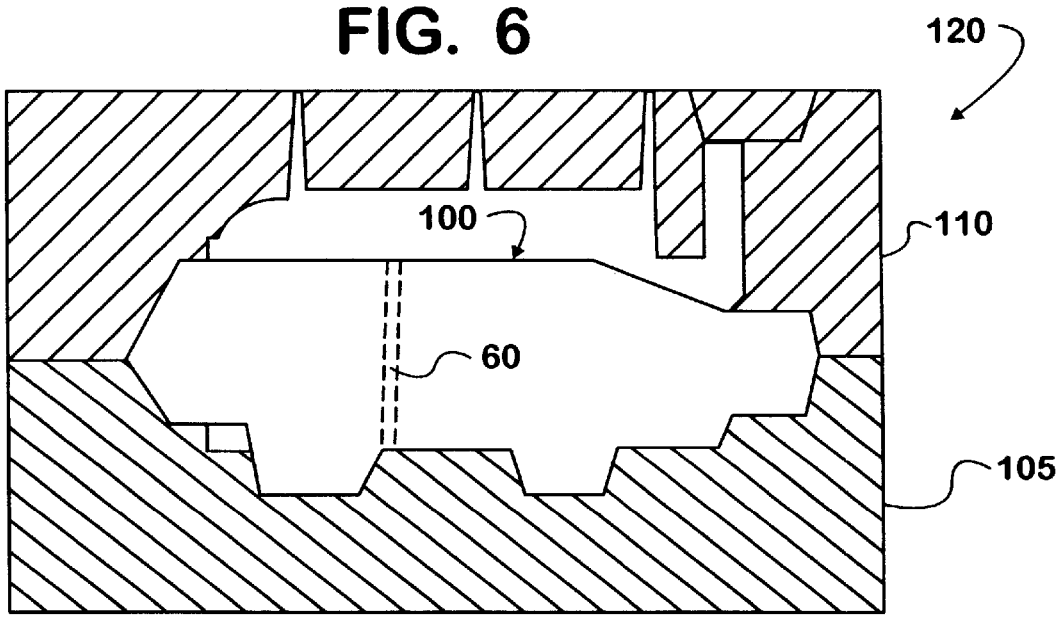
FIG. 6 diagrammatically illustrates the fastened head core assembly and green sand mold ready for casting.

FIG. 5 indicates how a core assembly 100 of this invention is assembled into a mold for casting a cylinder head. The core assembly 100 is placed in a lower mold half 105. With the core assembly 100 in position in the lower mold half 105, the upper mold half 110 is lowered into position to form a closed mold 120, as shown in FIG. 6. Molten metal is poured into the closed mold 120 as well known in the art, and the residue of the cured core sand/resin fastening body 60 can be removed from the casting with the residue of the core sand and resin that make up core elements 20, 30, 40, 50 after the casting is solidified.

Figure 7:
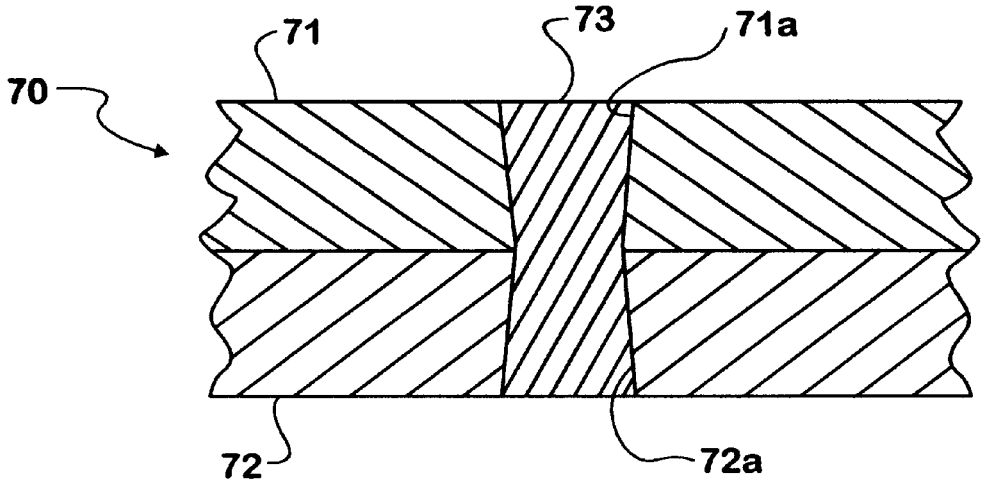
FIG. 7 diagrammatically illustrates core elements with preformed cavities providing interlocking engagement in an assembly of the invention.

FIG. 7 illustrates an assembly 70 of the invention comprising core elements 71, 72, both of which are formed from core sand and a cured resin with cavities 71*a*, 72*a* having tapered surfaces. The addition of a mixture of core sand and an uncured resin in the cavities 71*a*, 72*a* provides a body 73 of core sand and resin engaged with the tapered surfaces of the cavities 71*a*, 72*a*, which, after curing of the uncured resin, results in a cured solid body 73 of core sand and resin that interlocks the elements 71, 72 together. The cavities 71, 72 formed in the core sand elements as they are molded can have various and different interior shapes and configurations, such as square, rectangular or polygonal, with straight or tapered sides.

It will be apparent to those skilled in the art that the core elements may be varied in their design from cylinder head to cylinder head and for combustion-ignition diesel engines and gasoline engines and that the various core elements may be positioned and supported and provided with cured core sand/resin fastening bodies at locations different than and by methods different from those shown and described above.

While we have illustrated and described the best mode currently known for practicing our invention, other embodiments and methods of practicing the invention within the scope of the following claims will be apparent to those skilled in the art.

What is claimed is:

1. In a method of casting a cylinder head, the steps comprising providing a frame core having at least one core supporting and positioning surface, providing a one piece coolant jacket core having at least one core supporting and positioning surface, positioning the one-piece coolant jacket core on the frame core by engaging the core supporting and positioning surface of said coolant jacket core with said frame core, providing a one-piece exhaust core having a plurality of exhaust passage-forming portions extending transversely therefrom and at least one core supporting and positioning surface, positioning the one-piece exhaust core on the assembled frame core and coolant jacket core by engaging its at least one core supporting and positioning surface with the assembled frame core and coolant jacket core, providing an intake core having a plurality of intake passage-forming portions and at least one core supporting and positioning surface, positioning the intake core on the assembled frame core, coolant jacket core, and exhaust core by engaging its at least one core supporting and positioning surface with the assembled frame core, coolant jacket core and exhaust core, drilling a plurality of holes through the assembled cores, adding a mixture of core sand and a curable resin therefor to the plurality of holes, and curing said resin to retain the assembled cores in an integral assembly.

2. The method of claim 1, wherein the frame core, one-piece coolant core, one-piece exhaust core and intake core are formed with core sand and a cured resin and wherein the curable resin of the mixture added to the plurality of holes is the same resin as in the assembled cores.

3. In a method of assembly of at least two core sand elements for an internal combustion engine head casting assembly, the improvement comprising drilling a hole spanning an interface between the at least two core sand elements and retaining the at least two core sand elements in an assembly thereof by a body of cured core sand and resin spanning the interface between the at least two core sand elements.

4. In a method of assembly of an internal combustion engine head casting assembly comprising at least two core sand elements, the improvement comprising fastening the at least two core sand elements of the head casting assembly together by providing at least one cavity spanning the at least two core sand elements in the assembly by drilling into the at least two assembled core sand elements, inserting a mixture of core sand and a curable resin in the at least one cavity and curing the resin to provide at least one cured core sand/resin body fastening the at least two core sand elements together.

5. In a method of assembly of an internal combustion engine head casting assembly comprising at least two core sand elements, the improvement comprising fastening the at least two core sand elements of the head casting assembly together by providing at least one hole spanning the at least two core sand elements in the assembly by drilling hole portions through each of the at least two core sand elements with an expanded wall, the expanded walls of each of the at least two core sand elements expanding outwardly from the interface of the at least two core sand elements in the head core assembly, inserting a mixture of core sand and a curable rein in the at least one hole and curing the resin to provide at least one cured core sand/resin body fastening the at least two core sand elements together.

6. The method of claim 5 further comprising the step of placing a perforate holding plate over the at least one hole prior to inserting the mixture of core sand and a curable resin in the at least one cavity.

7. A method of assembling and retaining at least two core sand elements in an assembly for an internal combustion engine casting, comprising the steps of providing an alignable hole extending through each of the at least two core sand elements, aligning the holes in the at least two core sand elements, placing a perforate backing plate over the aligned holes of the at least two core sand elements, placing an uncured mixture of core sand and a curable resin in the aligned holes and curing the curable resin to retain at least two core sand elements in the assembly with the cured core sand and resin.

* * * * *